United States Patent [19]

Shimizu et al.

[11] Patent Number: 4,770,416

[45] Date of Patent: Sep. 13, 1988

[54] VOCAL GAME APPARATUS

[75] Inventors: Yousuke Shimizu; Ichirou Ishikawa, both of Tokyo, Japan

[73] Assignee: Tomy Kogyo Co., Inc., Tokyo, Japan

[21] Appl. No.: 55,253

[22] Filed: May 29, 1987

[30] Foreign Application Priority Data

May 30, 1986 [JP] Japan ..... 61-124896

[51] Int. Cl.[4] ..... A63B 71/06

[52] U.S. Cl. ..... 273/1 GC; 273/1 E

[58] Field of Search ..... 273/1 E, 1 GC, 1 GE, 273/85 G, 138 A, 237, DIG. 28; 340/384 R, 384 E

[56] References Cited

U.S. PATENT DOCUMENTS 4,285,517 8/1981 Morrison ..... 273/1 GC
4,309,030 1/1982 Goldfarb et al. ..... 273/1 GC
4,363,482 12/1982 Goldfarb ..... 273/1 GC

*Primary Examiner*—Maryann Lastova

*Attorney, Agent, or Firm*—Staas & Halsey

[57] ABSTRACT

A vocal game apparatus records arbitrary sounds and messages from game players. These recorded sounds correspond to input switches, which are different colors and contain a lamp for lighting. Players respond to the reproduced player recorded messages and the lighting of the lamps of the input switches in playing any of a plurality of games, all of which use the messages and light in some form, stored in memory of the vocal game apparatus. In a match game, the players must hit an input key in response to a match of a reproduced player message and lighting of a lamp of an input key. In a memory game, a player must correctly repeat a sequence of the colored input keys voiced by the vocal game apparatus by hitting the corresponding input keys in the proper order. The recorded messages may be changed as often as the players desire, thus giving the players a continuous interest in the vocal game apparatus.

9 Claims, 15 Drawing Sheets

GENERAL

RECORDING STAGE

PLAYER REGISTRATION

PLAYER REGISTRATION

LIGHT AND SOUND PRODUCING

VOCAL GAME APPARATUS

BACKGROUND OF THE INVENTION

The present invention relates to a vocal game apparatus for playing a game using recorded voices, and more particularly, to a game in which the players record the voices to be used.

Apparatuses are known for playing a game, etc. using recorded voices. That is, a player listens to a voice reproduced from a recording medium and performs a predetermined operation in accordance with an instruction related to the sounded voice. However, in such conventional vocal game apparatuses, since the voices are fixedly prerecorded and messages reproduced during the game remain unchanged, there is a problem in that they cannot create in the player who is familiar with such a game a continuous interest in that game.

SUMMARY OF THE INVENTION

With the above-described problem in mind, it is an object of the present invention to provide a vocal game apparatus which gives players the opportunity to record arbitrarily their own messages, also which reproduces the plurality of voiced messages or words in accordance with predetermined game contents, and in which a player competes (with other players or himself) for scores using the recorded messages or words and indications of lights.

To achieve the foregoing and other objects of the present invention and in accordance with the purpose of the invention, there is provided a vocal game apparatus, including: a plurality of input switches operated by one or a plurality of players; recording and reproducing means for recording voiced messages or words onto a recording medium at locations corresponding to respective input switches and reproducing the contents of the recording medium in response to a reproduce command; a plurality of lighting indication means, one corresponding to each input switch; and control means for receiving signals derived from said input switches and outputting signals to control operations of said recording and reproducing means and said lighting indication means, said control means in a first game operation lighting said lighting indication means at the same time when the words or messages from said recording and reproducing means are reproduced, and when the player operates one of the input switches (or the switch corresponding to himself in a multi-player game) when the reproduced message corresponds to and is coincident with the lighting of that lighting indication means, recording a score for the player. In a second game operation said control means controls the reproducing means to reproduce a sequence of the words or messages, and immediately following when the player operates the input switches in an order corresponding to the order of the produced sequence, the player scores a point and the process repeats with one additional word or message added to the sequence, until the player fails to correctly operate the input switches.

These together with other objects and advantages of the invention will become more apparent from the following description, reference being had to the accompanying drawings wherein like reference numerals designate the same or similar parts throughout.

DETAILED DESCRIPTION OF THE PREFERRED EMBODIMENT

Hereinafter, preferred embodiments will be described with reference to the attached drawings.

Figure 1:
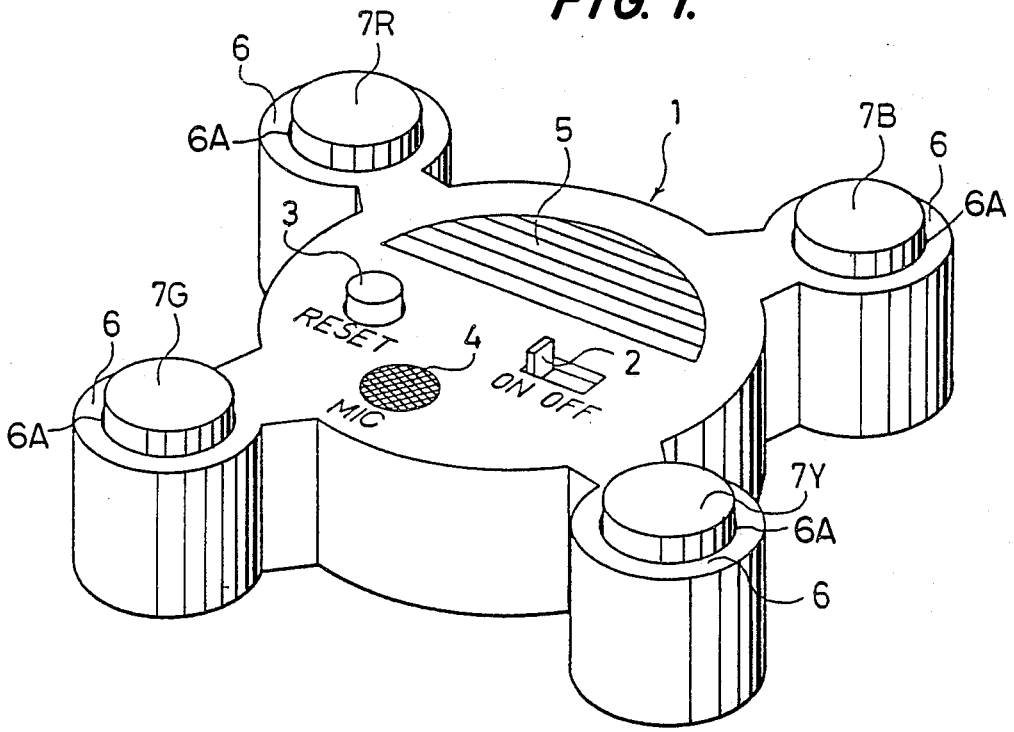
FIG. 1 illustrates the game apparatus of the preferred embodiment according to the present invention.

FIG. 1 illustrates one preferred embodiment according to the present invention. The vocal game apparatus is provided with a disk-shaped casing 1 from which four cylindrical convex portions 6 spaced 90° apart are projected in its radial direction. On the upper surface of the casing 1 are arranged an on/off switch 2, a reset switch 3, a recording microphone 4, and an output surface 5 of a speaker (FIG. 4) housed within the casing 1. In addition, a circular opening 6A is provided on the upper surface of each cylindrical convex portion 6. A cylindrical input switch key 7 is disposed, enabled to move up-and-down, within each opening 6A and projecting above each opening 6A. At least the upper parts of the four input switch keys 7 are made of transparent materials, and each switch key 7 is a different color. For clarity of description, starting from the upper left side of the apparatus in FIG. 1, the switch keys 7 are red, blue, yellow and green sequentially in clockwise direction as viewed from FIG. 1. Hence, when the four colored switch keys 7 are identified in the later description, they are referred to as color keys 7R (red), 7B (blue), 7Y (yellow) and 7G (green).

Figure 2:
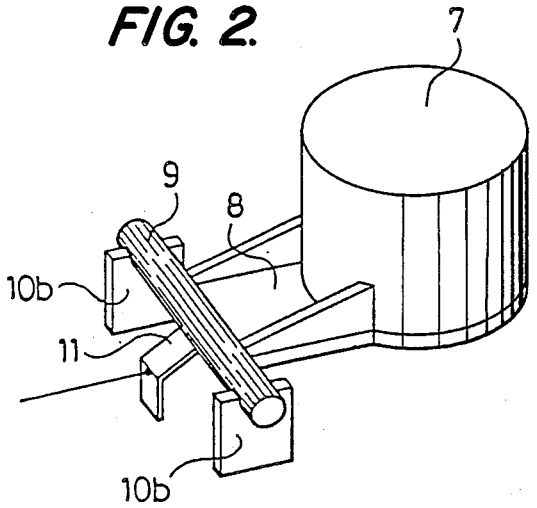
FIG. 2 shows the mounting portion of input switch keys used in the present invention shown in FIG. 1.
Figure 3:
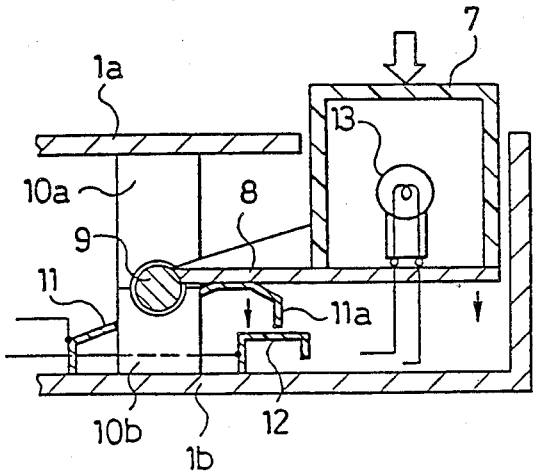
FIG. 3 is a side, cross-sectional view of one of the input switch keys shown in FIG. 1.

As shown in FIG. 2 and FIG. 3, each input key 7 is provided with an extended portion 8 extending from the lower part of the side surface of each key 7 toward the main body of the apparatus. A tip end of the extended portion 8 is integrally provided perpendicularly with a cylindrical shaft 9. Each switch key 7 is mounted within the casing 1 in each opening 6A so as to enable a pivotal movement in the up-and-down direction, with a shaft 9 pivotally grasped between two sets of up and down journal plates **10*a*, 10*b* installed on an upper plate 1*a* and a bottom plate 1*b* of the casing 1. Each switch key 7 is held in the position shown in the drawing by means of a switch piece 11 comprising a flexible metal plate bent so as to contact with a lower surface of the extended part 8, rising from the bottom plate 1*b* of the casing 1. A tip portion 11*a* of the switch piece 11 is bent downward and another switch piece 12 is fixed so as to face the tip portion 11*a*. The two switch pieces 11 and 12 are normally in a non-contact "off" position, held apart by means of an elastic force of the upper switch piece 11. However, if a player pushes down on an upper surface of any switch key 7, the tip 11*a* of the switch piece 11 contacts the switch piece 12, signalling an input. Each input switch is constructed in this way. An electric lamp 13 is arranged as lighting indication means inside each input switch key 7**.

Figure 4:
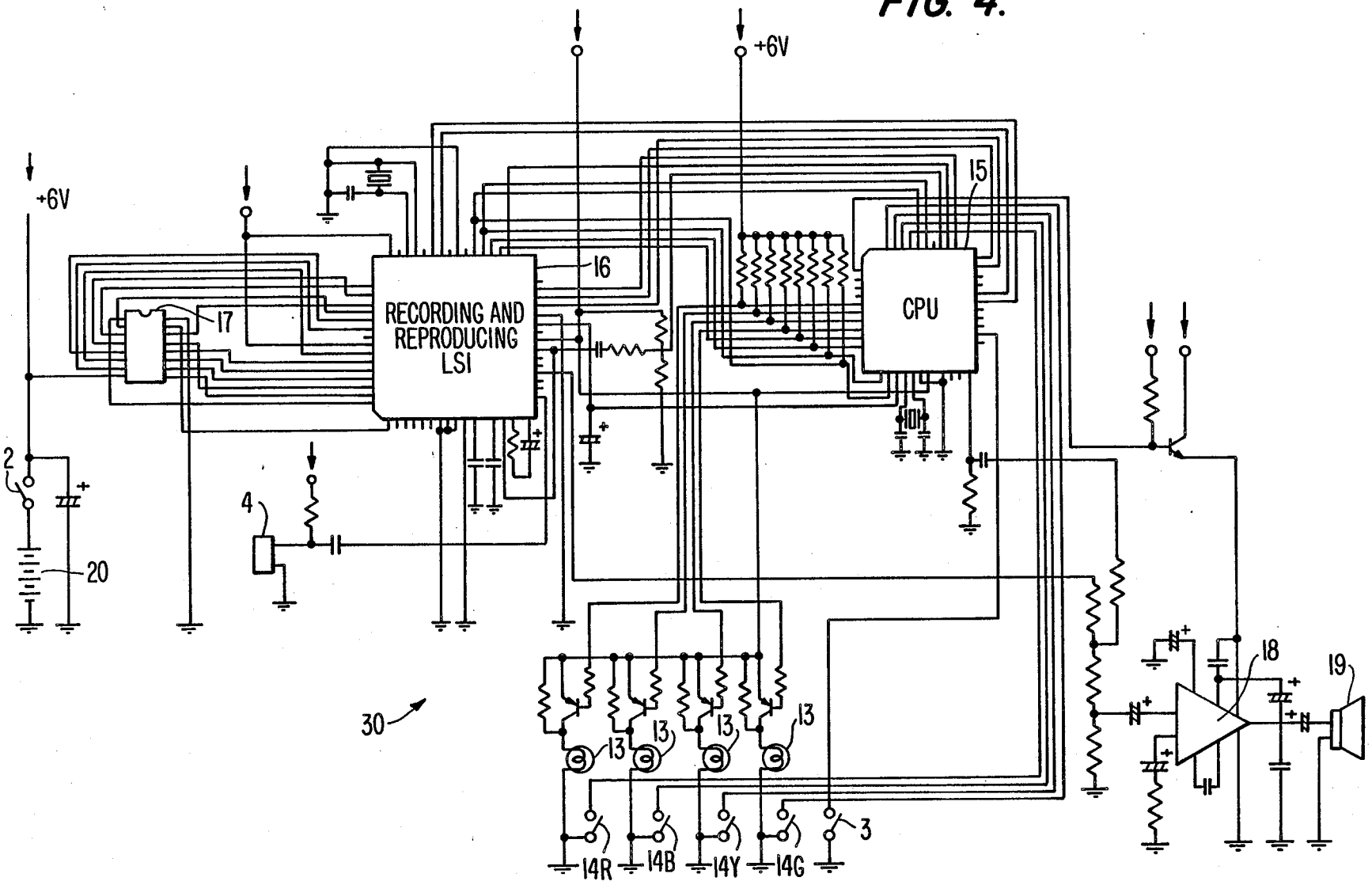
FIG. 4 is a circuit diagram showing an embodiment of circuitry of the game apparatus shown in FIG. 1.

A circuit 30 shown in FIG. 4 is housed within the casing 1. FIG. 4 schematically shows the reset switch 3 of FIG. 1, input switches 14R, 14B, 14Y and 14G (comprising switch pieces 11 and 12 corresponding to the four color keys 7R, 7B, 7Y and 7G as described above), the electric lamps 13 housed within respective color keys 7R, 7B, 7Y and 7G, a recording and reproducing large scale integration (LSI) chip 16 (which is readily available, manufactured by the Toshiba Corporation, Product No. T6668-BS) and semiconductor memory (RAM) 17 which records voiced messages or words corresponding to the respective input switches 14R, 14B, 14Y and 14G and reproduces the messages or words in response to a reproduce command. These elements are connected to a one-chip microcomputer (CPU) 15 (also readily available, Matsushita Electronic Corp. Product No. MN15543NTV) which serves as control means for the vocal game apparatus. The recording and reproducing LSI 16 is connected to the recording microphone 4 and to the speaker 19 via an amplifier 18. It is noted that this circuit uses four batteries 20 as a power supply and its voltage (6V) is supplied to the circuit via the on/off switch 2.

The recording and reproducing LSI 16 stores in the RAM 17 the voiced messages or words inputted into the microphone 4 corresponding to the input switches 14R, 14B, 14Y and 14G during a recording process. Vocal data is fetched from the RAM 17 at random, outputted as a vocal signal, and sent to the speaker 19 via the amplifier 18 in order to reproduce it.

Next, a game action according to the preferred embodiment will be described.

First, this embodiment is such that the players record a message or sound corresponding to each one of the four color keys 7R, 7B, 7Y or 7G and each of the one to four players selects one of the color keys 7R, 7B, 7Y or 7G as his or her home position. During a game selection stage, a match game selected by pushing the red color key 7R and the memory game is selected by pushing the blue color key 7B. In the match game, each of the one to four players selects one of the color keys 7R, 7B, 7Y or 7G as described above as his home position. In the one player only memory game, the apparatus automatically designates the red color key 7R as the player's home position. After the game is finished, scores can be confirmed by voice and light indications.

In the game referred to as the match game, voiced messages or words prerecorded by the players corresponding to the four color keys 7R, 7B, 7Y and 7G are reproduced at random by the game apparatus, and simultaneously the electric lamp 13 of one color key is turned on at random. When the reproduced voice corresponds to the lighted color key and a player pushes that color key, the apparatus adds a point to the score for that player. The score calculation is such that one point is added to the player's score whenever one correct key is operated and one point is subtracted when the player incorrectly pushes a color key 7 or fails to push the correct corresponding key within a predetermined period of time.

On the other hand, in the memory game the apparatus sequentially specifies at first three color keys from among the four color keys 7R, 7B, 7Y and 7G through their corresponding prerecorded voiced messages or words. A score is obtained when the player enters the specified color key sequence in the same order as specified by the reproduced voices. This is referred to as a player repeat. After each score, the length of the specified color keys sequence is increased by one. The game is over when the player fails to enter the sequence in the proper order, the sequence is not entered within a certain period of time (for example, 10 seconds), or the length of the specified color key sequence has reached an upper limit (for example, 32).

Hereinafter, an operation and game procedure required for carrying out the above-described games will be described with reference to the flowchart shown in FIG. 5–FIG. 12.

Figure 5:
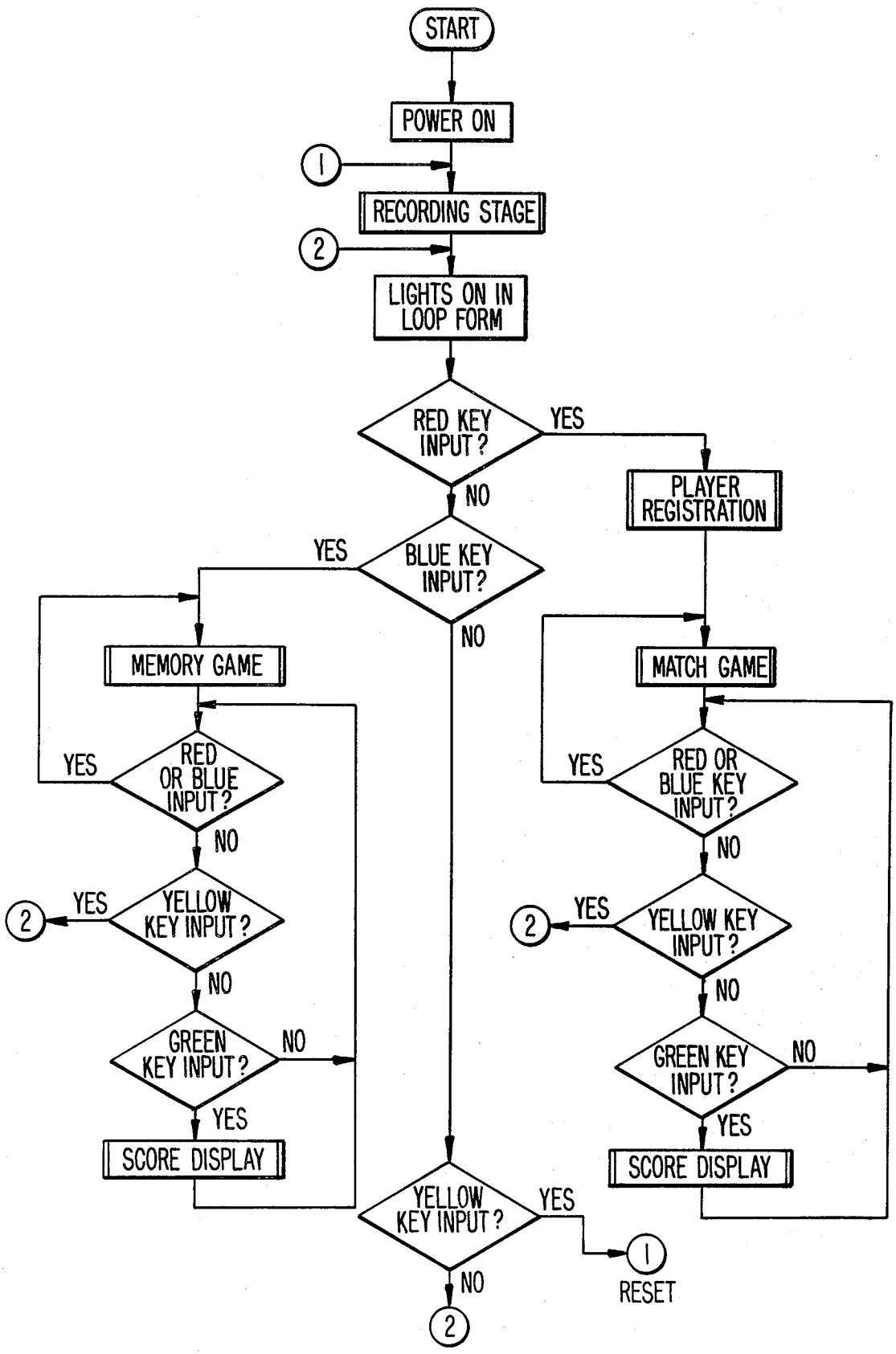
FIGS. 5, 5A, 6, 7, 7A, 8, 8A, 9, 10, 10A, 11, 12, and 12A are flowcharts indicating processing procedures for the game apparatus according to the present invention.
Figure 6:
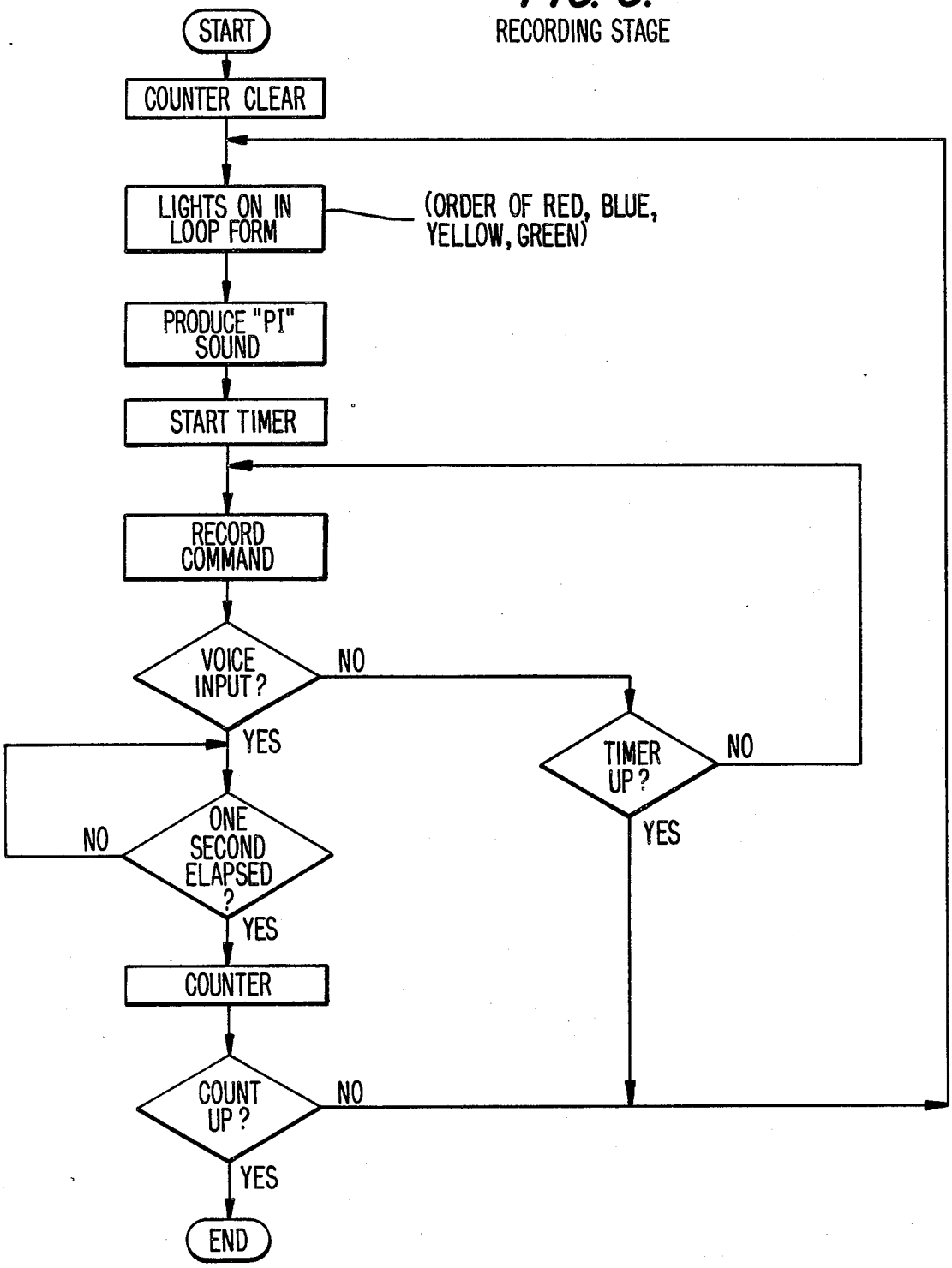

First, as shown in FIG. 5, when the on/off switch 2 is turned on, the game apparatus enters a record enable state. In this embodiment, to make a 8-word record for the voice, the CPU 15 first clears a word number counter as shown in FIG. 6, next illuminates in a loop form mode the four color keys 7R, 7B, 7Y and 7G in this order to command the player to record and produces a repeating sound such as "PI", "PI". At this time, the CPU starts a timer defining an illumination time of each color key. Then, the CPU 15 sends a record command to the recording and reproducing LSI 16 to wait for the voice input. When a color key is illuminated and the player voices a word, a recording corresponding to that color key is carried out. That is to say, the voice of the player is inputted from the microphone 4 and is stored in a predetermined memory location of the RAM 17 as the vocal data by means of the recording and reproducing LSI 16.

It should be noted that since the voice stored in the RAM 17 is within one second per word, the CPU checks to see whether one second has elapsed whenever the voice is inputted and thereafter counts the word number. In addition, since the voice to be recorded is used in the above-described two kinds of games, the first four words of the eight words specifies a name of each color key 7R, 7B, 7Y and 7G (for example, name of each player) and the subsequent four words specifies a color designation or other type of player specified word code for each color key 7R, 7B, 7Y and 7G (for example, red, blue, yellow, green).

When the above-described recording is completed, the game apparatus enters a game selection mode and the CPU 15 lights the four color keys 7R, 7B, 7Y and 7G sequentially a predetermined number of times in this order in a loop lighting form. At this time, when a player depresses the red color key 7R or blue color key 7B, the above-described match game or memory game is selected. In addition, when the yellow color key 7Y is depressed, the apparatus returns to the record enable state and can record messages corresponding to each color key again. In this way, the yellow color key 7Y has a function as a reset key.

Figure 7:
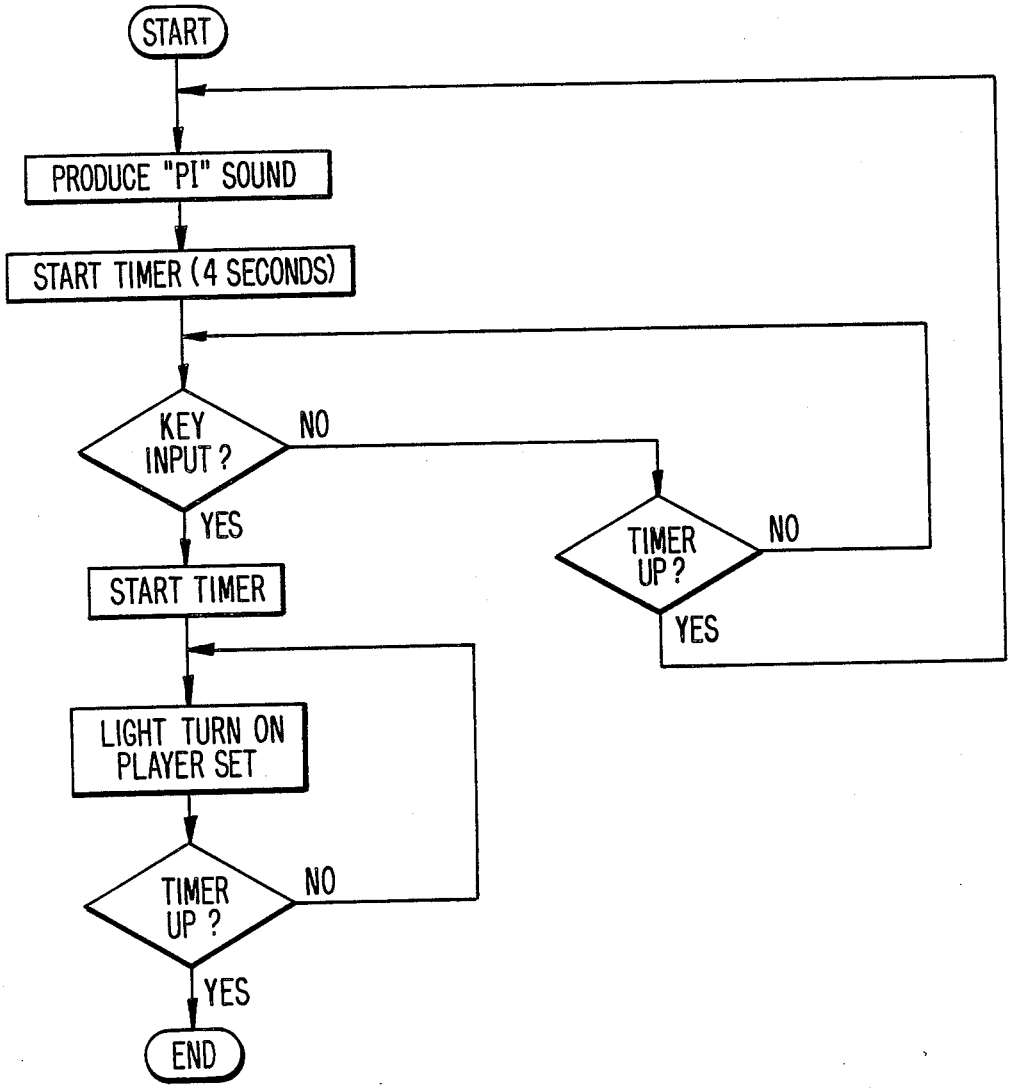

When the red color key 7R is depressed during the above-described loop lighting mode, the match game is selected, and a player registration procedure follows. This procedure starts with a generation of such a repetition sound as "PI", "PI" as shown in FIG. 7. If the player sequentially depresses each color key 7R, 7B, 7Y and 7G within a predetermined period of time (for example, four seconds after either of the color keys is depressed), the corresponding light is turned on and the number of players and positions are registered. For example, if the number of players is three (suppose that the three players are A, B, and C) and A depresses the red key 7R, B depresses the blue key 7B and C depressed the yellow key 7Y, these color keys function as operation keys and home position for the respective players. Then, after a start melody, the match game begins.

On the other hand, when the blue key 7B is depressed during the above described loop lighting mode, the memory game is selected, and the above-described player registration is omitted. With the red color key 7R being automatically selected as a home position, the game is continued in accordance with procedures shown in the flowcharts of FIG. 10 and FIG. 11. Upon completion of the match game or the memory game, if the red or blue color key 7R or 7B is depressed, the apparatus returns to a start state of the corresponding game. When the yellow color key 7Y is depressed, the apparatus again lights on each color key in the loop lighting mode for recording messages for each switch key 7. In addition, when the green color key 7G is depressed, the score of the last game is reconfirmed in accordance with procedures shown in the flowchart of FIG. 7 to be described later.

Next, a further detailed description of the match game will be described with reference to FIG. 8.

As described above, when the match game is selected and player registration is completed, the beginning of the game is signaled by the playing of a start melody. The CPU 15 selects one of the following two procedures according to the number of players based on the number of players registering, i.e., depending on whether the number of players is one or two to four.

The Match Game for One Player

First, the sole player is preset to have ten scores. This is because the score is decremented by one whenever the player makes a mistake (fails to press the appropriate color key at the proper time or presses the wrong key at any time), and the game is over when he makes ten such errors. During the game, processing is carried out as to slowly change the time interval between each set of lighting and issuing sound, i.e., the time interval from the lighting of the subsequent color key and the producing of the subsequent voice in order to make the game gradually more difficult by shortening the length of time between the lighting and sound sets by a predetermined time (for example, 10 msec.) whenever the voice is once produced regardless of the score. The four different voiced messages which have been recorded (for example, names of the respective color keys) are produced at random at the time intervals set in the above-described processing and the lights of the respective color keys are turned on at the same timings at random until the game is over. These lighting and sound producing operations are executed on the basis of random numbers ranging from zero to n generated in the CPU 15.

Figure 9:
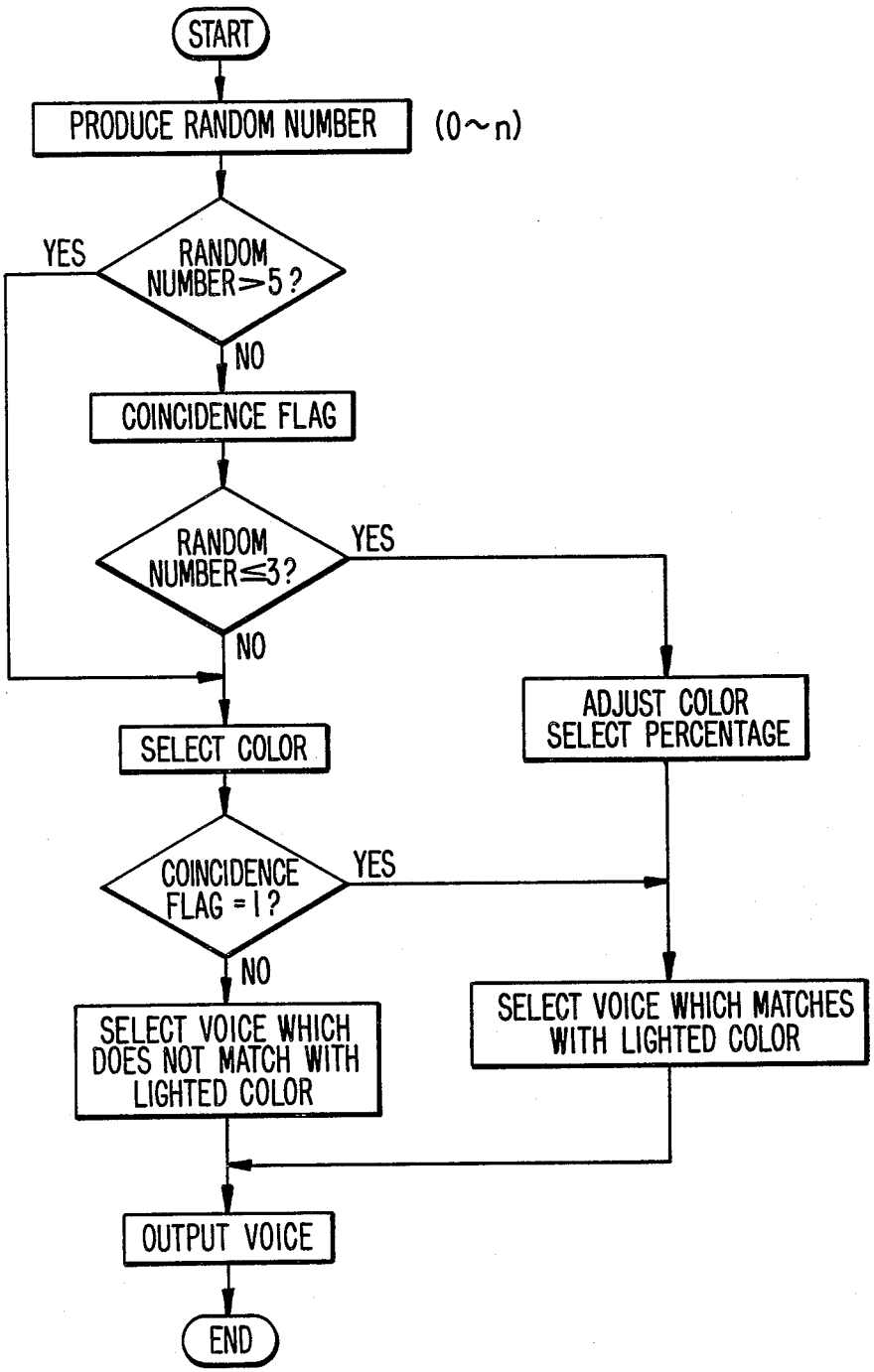

The lighting and sound producing operations shown in FIG. 9 will be described hereinbelow. Although the numbers from zero to n (n denotes a natural number) are produced at random, n is different depending on whether the number of players is one or two to four. For example, when the number of players is one $n=15$, and when the number of players are two to four $n=8$. Depending on the number generated during the random processing, whether or not to match the recorded message to the color key being lit is determined. In detail, if the random number is greater than five, the color key being lit is not matched with its corresponding message and one of the messages which does not correspond to the color key being lit is outputted. If the random number is equal to or less than five, a coincidence flag of the CPU 15 is set to 1. If the random number is equal to or less than three, the color key which has been lighted the least number of times is lighted and the voice corresponding to the lighted color is produced, and a percentage of selection for the lighted color keys is adjusted. That is, the overall percentage that this particular color key has been lighted is adjusted upward, and the percentage of lightings for the other keys is adjusted downward. Furthermore, if the random number is neither equal to nor less than three (the random number is four or five), the message corresponding to the randomly lighted color key is produced.

In this way, a probability of matching the lighting of the color keys with its respective word is 6/n in the lighting and sound producing operations. As described above, n is different depending on whether the number of players is one or two to four. This is because in the case where the number of players is two to four, each player may perform a key operation only if the lighting of the color keys at his own home position is matched with the message. A probability that the lighting of the color key is matched with the message for each player becomes less than 6/n. Hence, the above-described n in the case of one player is set larger than that in the case of two to four players to adjust the percentage of selection, thus guaranteeing approximately the same degree of player participation in both the 1 and 2–4 player games.

When the one player depresses a color key which is lighted and the reproduced voice corresponds to that color key, the player scores a point. For example, when the blue color key 7B is lighted and the word corresponding to the blue color key 7B is reproduced, the player gets one point if he depresses blue color key 7B. On the other hand, if he depresses a color key different than the lighted color key when a lighted key/reproduced voice match occurs, or depresses any color key when no lighted key/reproduced voice match occurs, or does not depress the lighted color key when a lighted color key/reproduced voice match occurs, one point is decreased from the total running score. At the same time, one point is decremented from the permissible failure score (which was originally preset at ten).

When one player is playing and the number of times the player fails reaches ten, the game ends. The final score is then indicated after a predetermined melody is sounded. The game will also end when the number of times the above-described voice producing and lighting operations has reached a predetermined number (e.g., 400 times) even if the number of times the player has failed has not reached ten.

Figure 12:
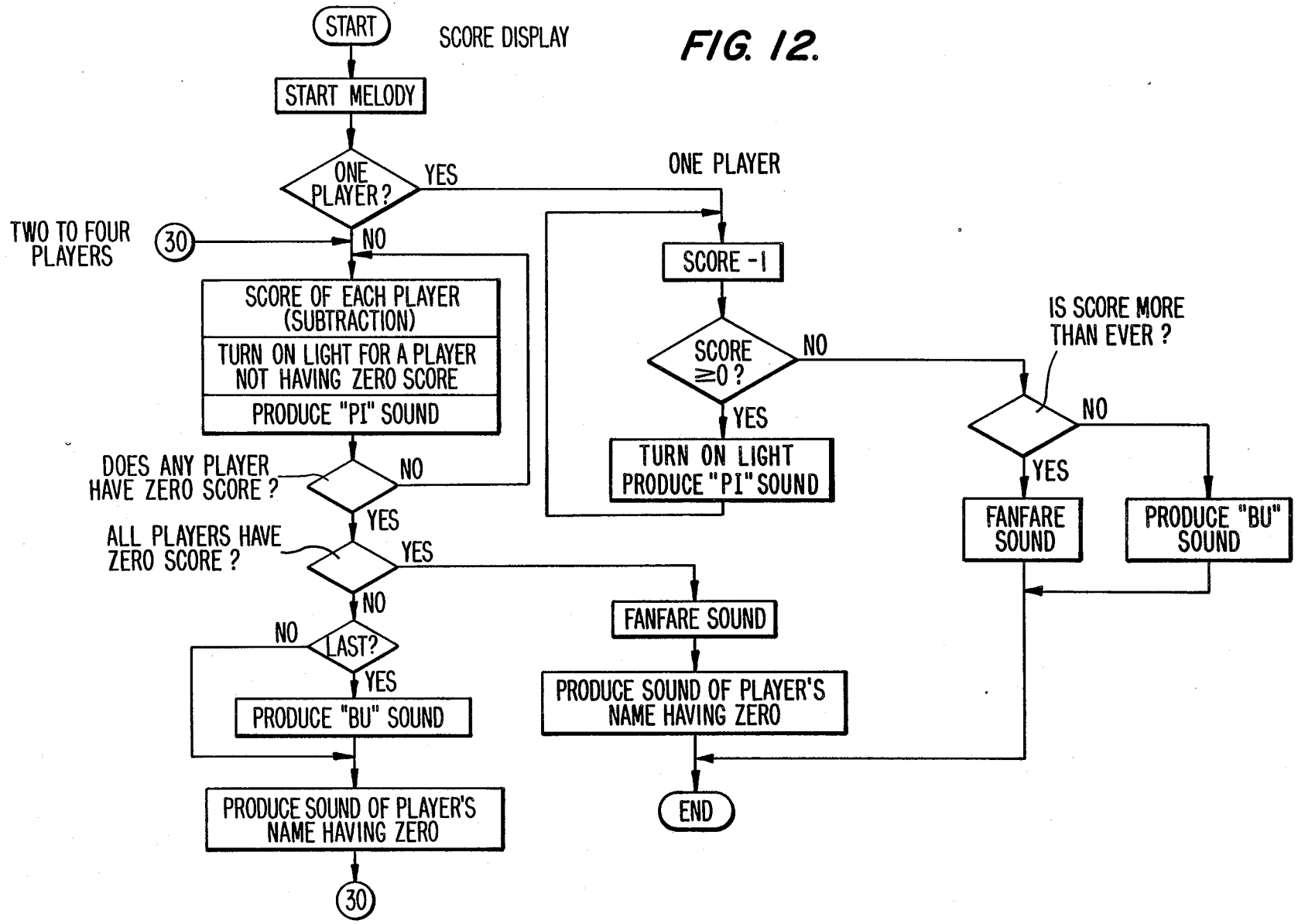

The total score indication is carried out in accordance with the flowchart shown in FIG. 12. First, a score melody is produced and the CPU determines whether the number of players is one. Then, for one player, the score is calculated and the score indication is carried out in such a way that the tens digit of the score is indicated by the number of times the color key chosen by the player for his home position is turned on for one second, and the units digit of the score is indicated by the number of times the same color key is turned on for 0.3 seconds. For example, when the color key specified by the player is the red color key 7R and his score is 25, the lighting of the light of the red color key 7R is repeated two times for one second and is repeated five times for 0.3 seconds. In addition, the repeating sounds such as "PI", "PI" are produced at the same time as the above-described lighting repetitions.

Thereafter, although a predetermined fanfare sound is produced at the end of first game even when the preset score is further subtracted and the total score becomes a negative number, at the end of second and subsequent games the score of that game is compared with the highest score of previous like games during the same session (since the apparatus was turned on). If the present score is greater than the previous high score, a fanfare sound is produced. If the present score is less, such a sound as "bu" is produced.

After the score is indicated, if the same game is to be played again, the player depresses the red or blue color key 7R or 7B. In a case when the different game (in this case, the memory game) or when the match game is to be played with the different number of players, the yellow color key 7Y is depressed. At this time, the routine returns to (2) in FIG. 5, the lights are in the loop lighting mode, and the new game can be selected. At this time, if the red or blue color key is depressed, the corresponding game is selected. In addition, if the score in the previous game is to be reconfirmed, the green color key 7G is depressed.

The Match Game for Two to Four Players

Figure 8:
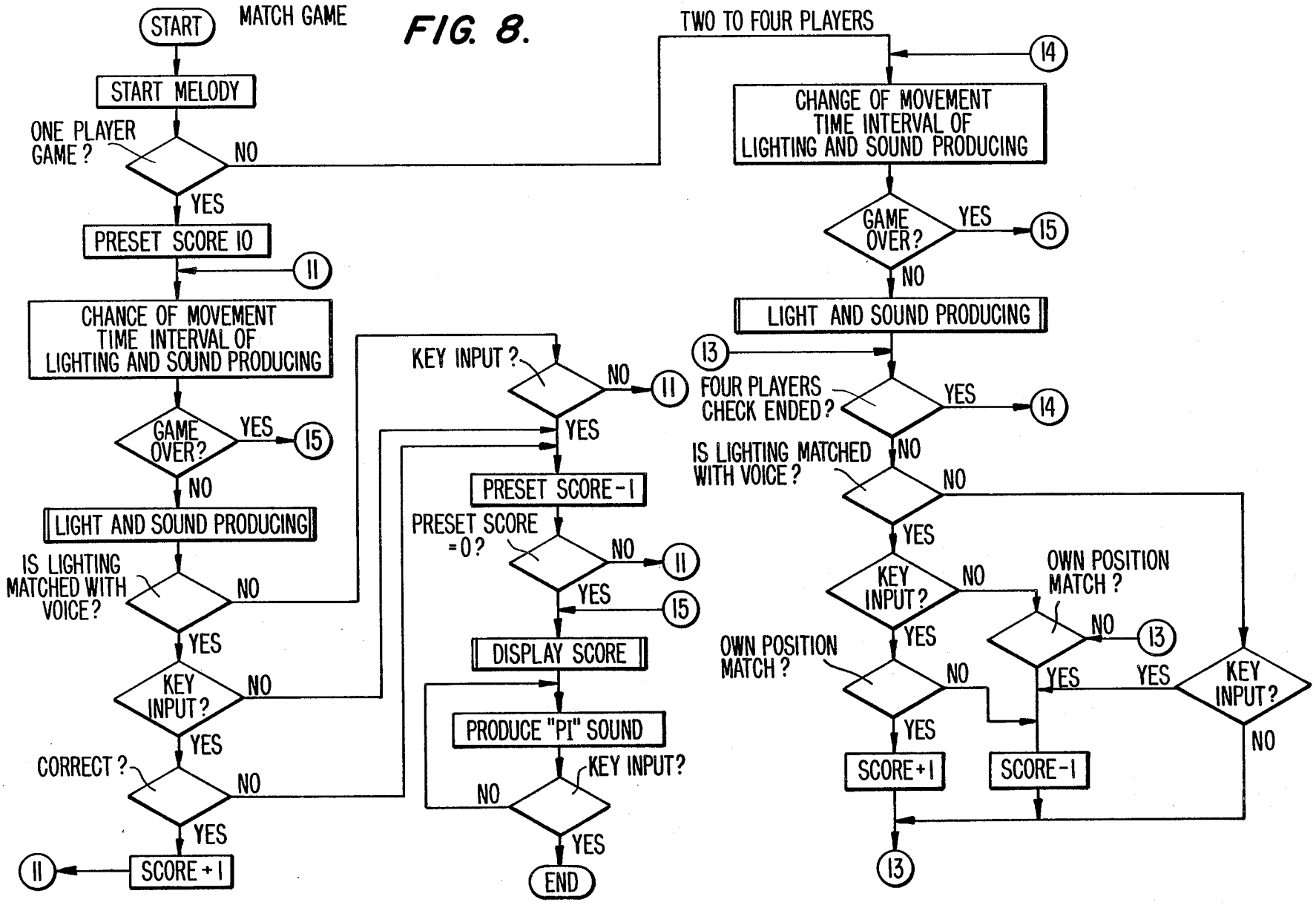

As shown in FIG. 8, the players' scores are not preset at 10, and the processing that determines the time interval of the lighting and sound producing procedure is changed to vary the difficulty of the game. Then, the four voiced words (for example, names of the respective players) which have been recorded are produced at time intervals defined at the above-described processing and simultaneously the light of a color key is turned on. This lighting and sound producing operations are the same as those in the case when the number of players is one, except the value of the random number for determining whether to output a match is different (n=8).

However, in the case of two to four players, a four-person check is carried out whenever one lighting and sound producing operation is carried out. This is a check to see sequentially whether a key operation is correct for a color key to which the above-described player registation is performed. At this time, each player gets one score by depressing his color key at a time interval in which his color key lights and the sound produced corresponds to his color key (which he chose when the player registration was carried out). On the other hand, if the player fails to depress his color key when it is lighted and the corresponding voice is reproduced or if the player depresses his color key when there is no match, the player's score is decreased by one. When the game starts the time interval between consecutive lighting and sound producing operations is set to one second. The time interval decreases by a predetermined period of time (for example, 8 milliseconds) whenever a lighting and sound producing operation is carried out. When the time interval reaches below a predetermined period of time (for example, 0.5 seconds), the subtraction value is reduced (for example, to 2 msec.). Thereafter, when the time interval has reached a predetermined lower limit time (for example, 0.3 seconds), the lighting and sound producing operations are subsequently repeated at the lower limit time interval.

Although the game for the two to four players is played in this way, the game is over when the time interval between consecutive lighting and sound producing operations has reached a predetermined value (for example, 0.4 seconds) and thereafter all players make an error. After a predetermined melody is produced, the scores are displayed.

The score display procedure is such that a score melody is first produced as shown in the flowchart of FIG. 12. Next, the score of each player is indicated. The electric lamp 13 of the color key of each player is turned on repeatedly for 0.3 seconds and a simultaneous "PI" is sounded. Each coinciding flash and "PI" sound represents a point scored by the players, and simultaneously with each flash and "PI" sound one point is decremented from each players' score. When the score of the player who had accumulated the least number of points reaches zero, the flashing and sounding cease, a "bu" sound is produced and the apparatus indicates the identity of the last placed player by producing the word or message corresponding to his home position. This process is repeated for the remaining players, until only the player who accumulated the most points remains. When his score is finally decremented to zero, a fanfare is sounded and that player is identified as described above.

The operation following the end of the game for two to four players is the same as that in the one player game.

The Memory Game

Figure 10:
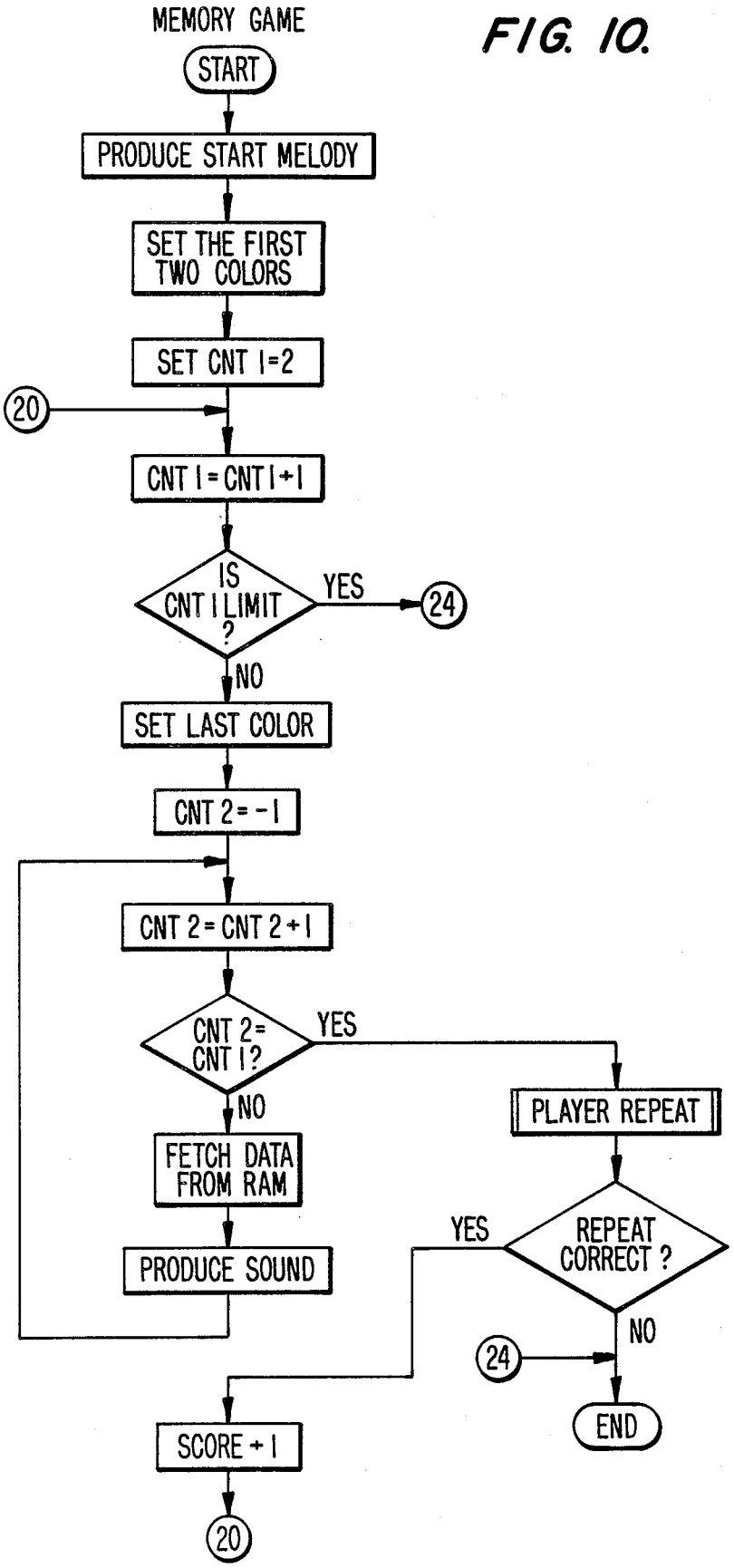
Figure 11:
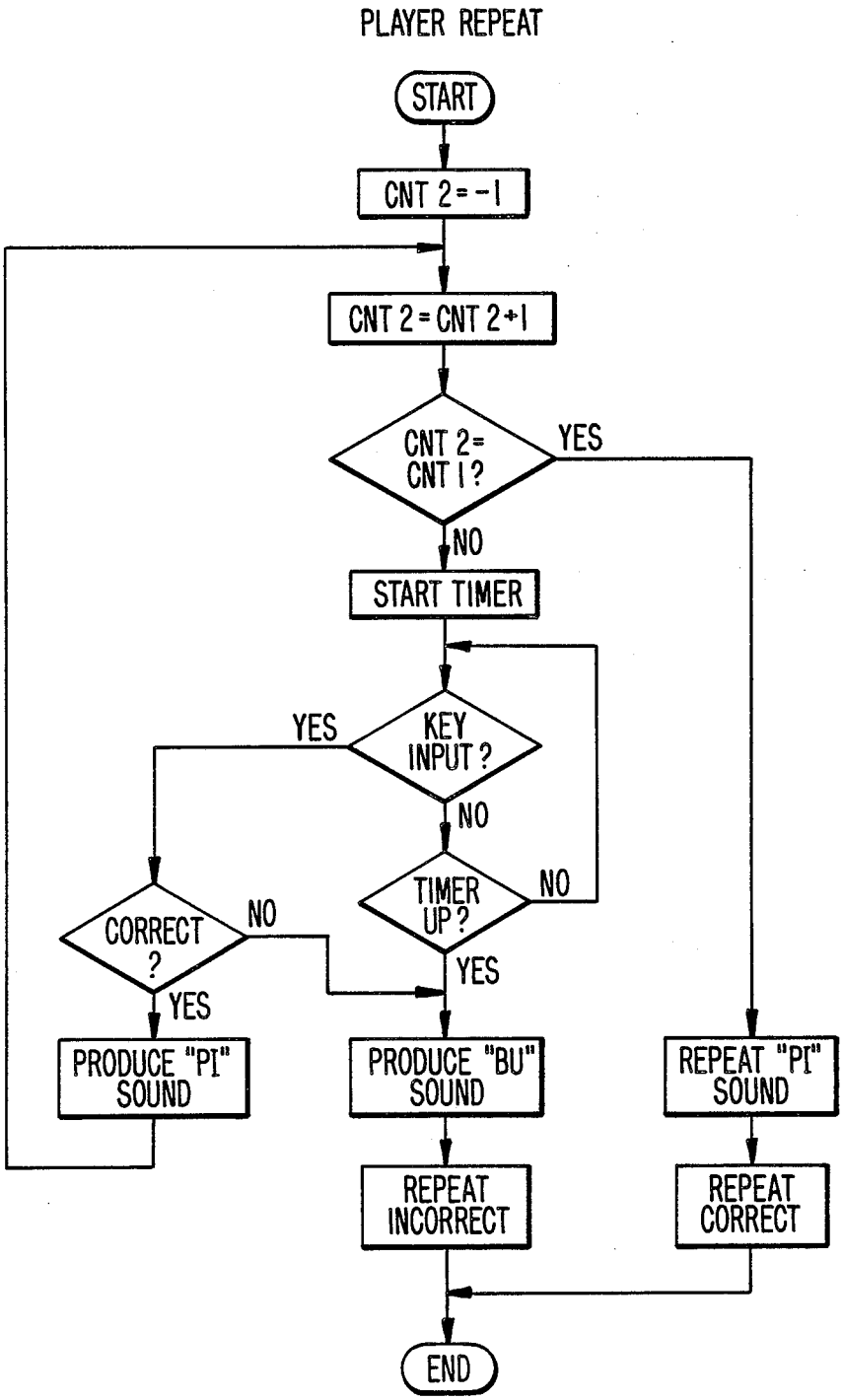

Next, the memory game will be described with reference to FIG. 10 and FIG. 11.

When the memory game is selected by depressing the blue key 7B during the above-described loop lighting mode, a one player game automatically begins with the red color key 7R as the player's home position.

First, a start melody is rung and three color keys are sequentially designated (the same key may be specified twice). Then, the CPU 15 adds one to a value of a specified number counter CNT1, which is set at an initialization state to two (2), resulting in three (3) being stored in CNT1. Thereafter, the counter is incremented by one after each successful player response, which is described below. When the value reaches an upper limit (e.g., 32), the game ends. In addition, in this game, this counting corresponds to the increasing length of the color key sequence, in which a newly selected color is added after the last specified color of the preceding sequence.

Therefore, initially, with the last color selected sequentially, one is added to a value of a color specification counter CNT2, set to (−1) at the initialization state, to give zero. Thereafter, one is added thereto whenever a color is specified and output by the reproducing means. When the value of the counter CNT2 is matched with the value of the specified number counter CNT1, a "player repeat" is carried out.

Since at first three prerecorded words corresponding to the color keys, such as red, blue and green, are sequentially sounded, the player depresses those color keys in that order. When this "player repeat" is correctly carried out within a predetermined time, a repeating sound such as "PI", "PI" is produced and one point is awarded to the player. Next, the game apparatus reproduces the above word sequence again and adds a new word following the above-described sequence, so as to now specify four colors, and waits for the "player repeat".

Upon a successful player repeat, again the repeating "PI" sound is produced and the player is awarded another point. A new color is added to the end of the specified color sequence just repeated by the player. In this way the sequence length grows until one of two events occurs. If the player fails to repeat the sequence properly or the sequence reaches a predetermined maximum length (for example, 32), then the game ends. In the first case, the game apparatus produces a "bu" sound, the score melody is sounded, and the score is displayed. In the second case, when the player correctly repeats the sequences until the predetermined maximum sequence length is reached, the score melody is sounded and the score display procedure operates in the same way as in the match game.

Alternate Embodiment

Figure 5A:
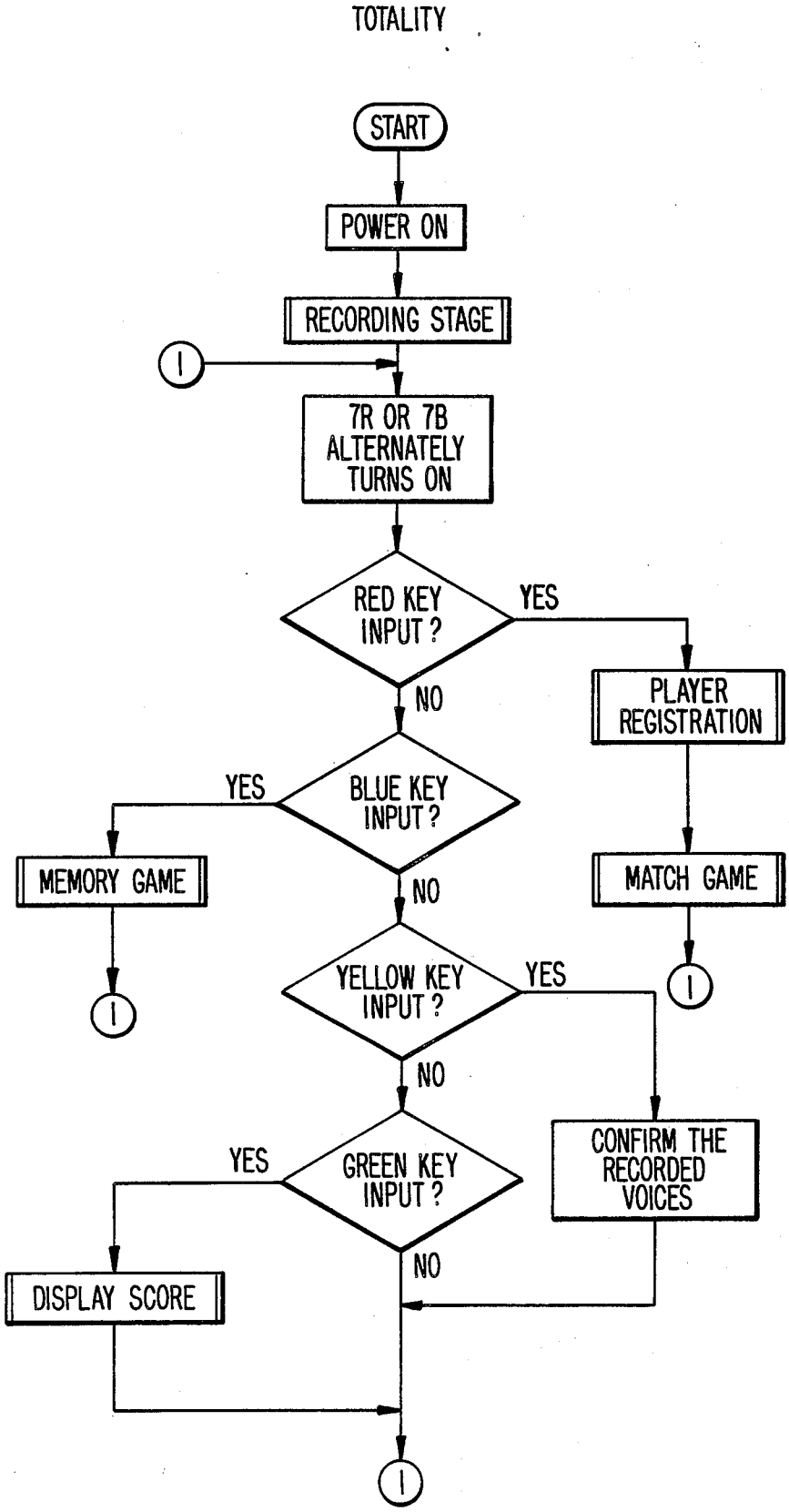
Figure 7A:
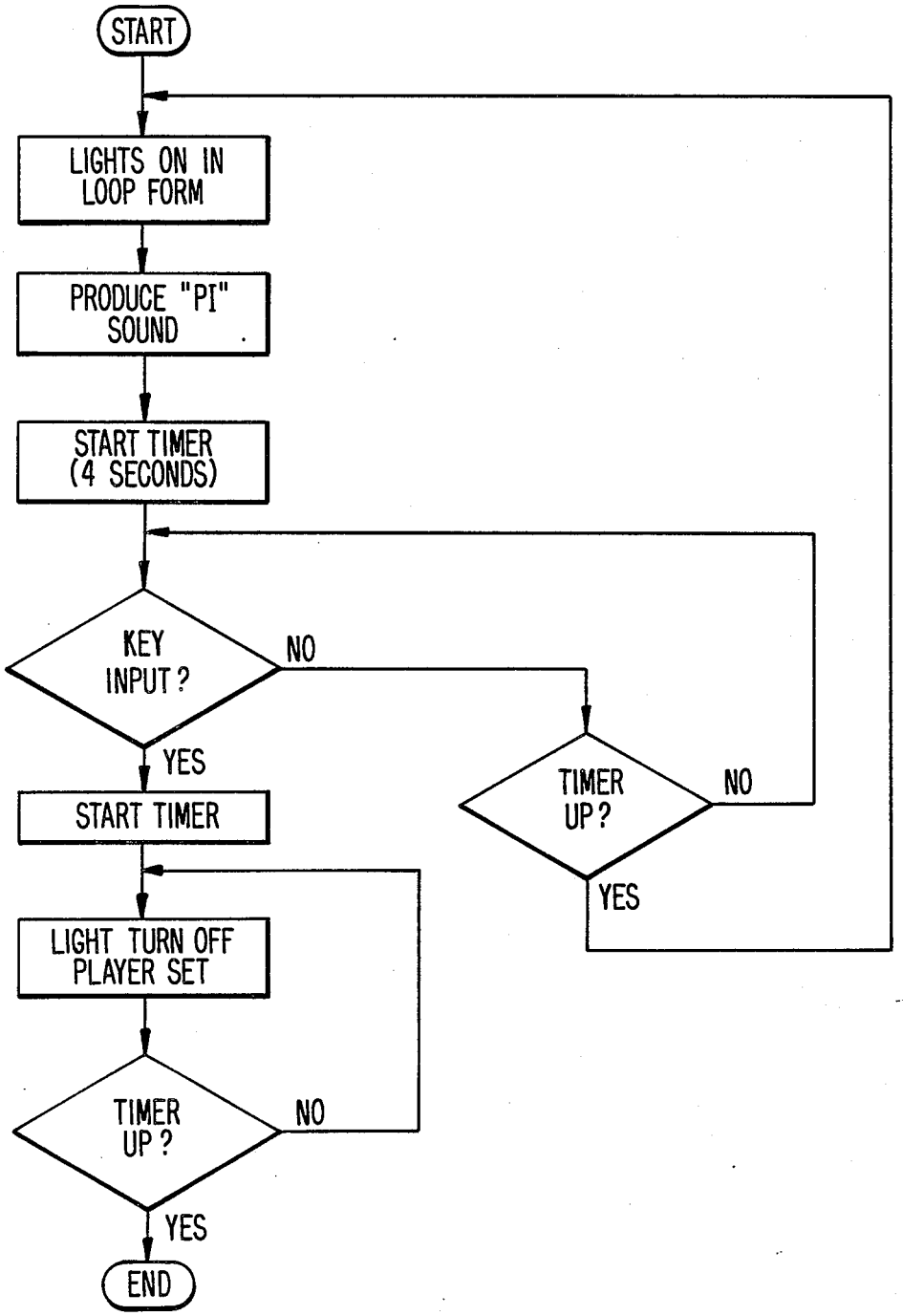

In an alternate embodiment for the present invention, the procedures for playing the match game and the memory game are slightly different. The differences between this alternate embodiment and the above-described embodiment are found in the flowcharts 5A, 7A, 8A, 10A and 12A, which take the place of flowcharts 5, 7, 8, 10 and 12 of the above-described embodiment respectively in the case of this alternate embodiment. As per FIG. 5A, the first step of the second embodiment is the recording of the voices. In this embodiment, only four words or voiced messages are recorded, one corresponding to each of the color keys 7R, 7B, 7Y and 7G. After the recording is completed, the red and blue color keys 7R and 7B alternately turn on. If the red input key 7R is pressed, the match game has been chosen and a player registration as per the flowchart of FIG. 7A is begun. The only difference between this player registration and the player registration of first embodiment is that the lights alternately turn on around the loop upon the choosing of the red color key 7R, representing that the player registration stage has been entered.

Figure 8A:
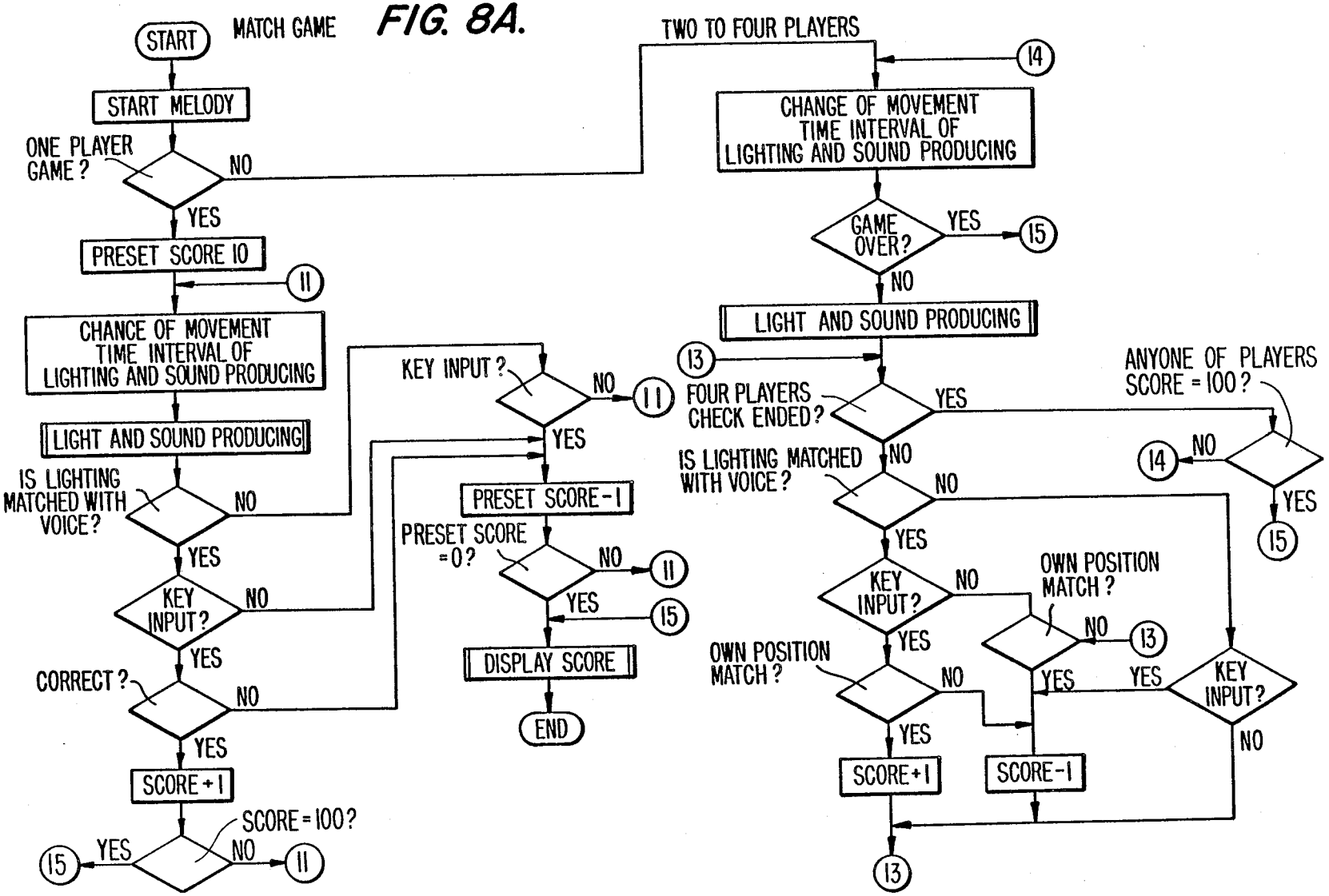

The differences between playing the match game of the second embodiment as opposed to that of the first embodiment are found in the flowchart of FIG. 8A. In the alternate embodiment, the game ends when the score of any one of the players reaches 100.

Figure 10A:
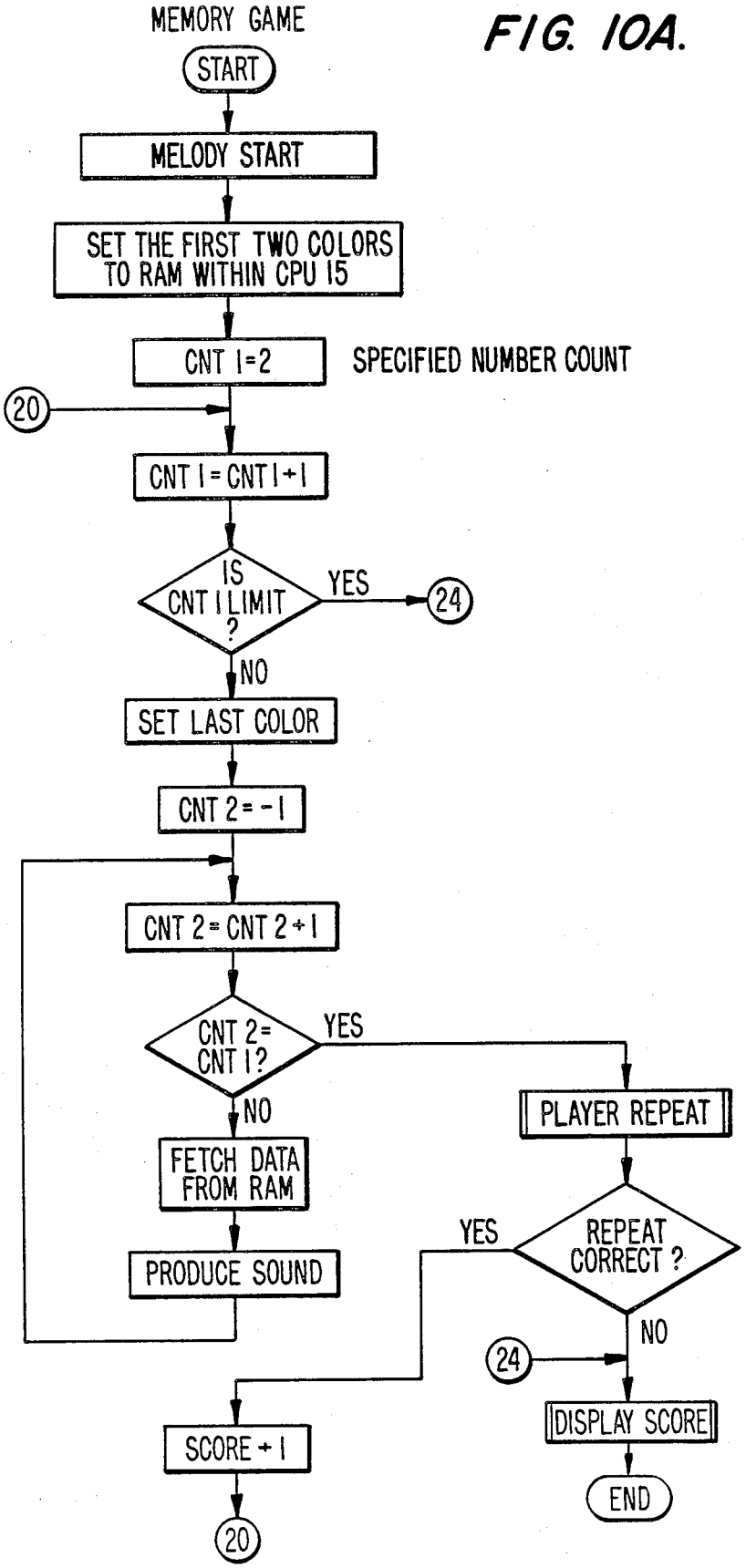
Figure 12A:
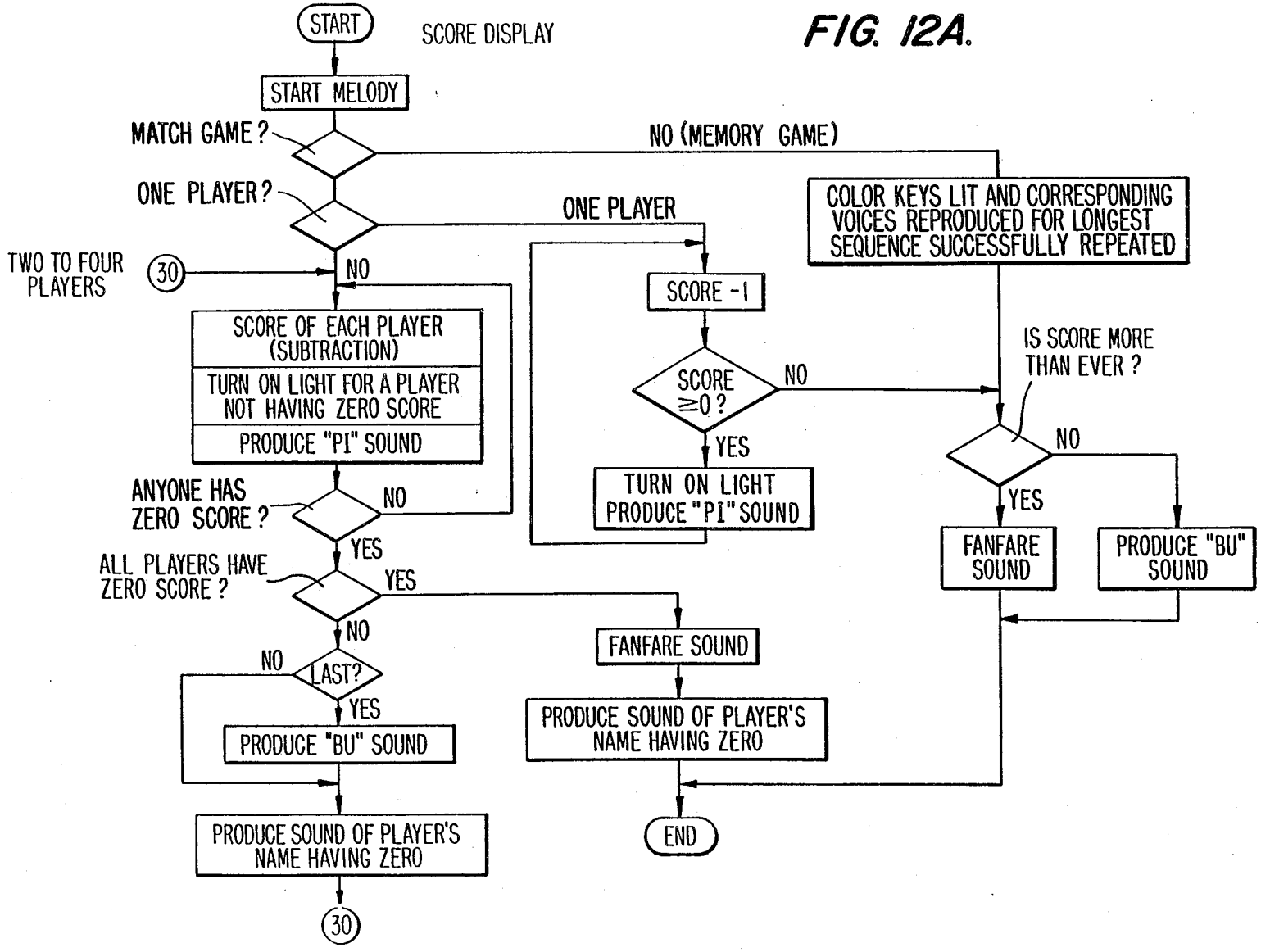

Differences also exist between the memory game of the alternate embodiment and the memory game of the first embodiment. In the alternate embodiment, the sequence length limit is 100 rather than the 32 of the first embodiment. That is, upon a successful player repeat of a 100 word sequence, the highest score possible has been achieved and the game ends. Also, as seen from the flowchart in FIG. 10A, a score display step has become part of the memory game procedure. A special memory game display score step has been added, as shown in FIG. 12A. When the one player memory game has been completed, the longest sequence successfully completed by the player is reproduced by the game apparatus. During this playback, both the color key is lit and the corresponding voice reproduced for each step of the sequence. If the sequence that has been successfully reproduced is the longest reproduced so far during a given playing session, a fanfare is sounded upon completion of the repeat by the apparatus. If it is not the best score during a given session so far, a "bu" sound is reproduced.

Upon completion of either the memory game or the match game, the game selection mode begins again. Once again, the red and blue color keys 7R, 7B are lighted alternately. At this point, if the red color key is pressed, the match game procedure begins again; if the blue color key 7B is pressed, the memory game procedure begins again. As per the flowchart of FIG. 5A, another difference over the first embodiment is illustrated. If the yellow key is pressed at this point, each color key is lighted once going around the loop, and at the same time as the lighting, the recorded word corresponding to that color key is reproduced, thus confirming the recorded voices. If the green color key 7G is pressed, the score for the last game played is once again displayed. After either the step of confirming the recorded voices or displaying the score of the last game, the procedure returns to the step of alternately lighting color keys 7R and 7B.

Although the preferred embodiments have been described hereinabove, the present invention is not limited to these embodiments. For example, although the input switch keys are identified by colors, they may be identified by their profiles and so one. In addition, the game which carries out the plural kinds of voices which have been recorded and lights are not limited to the kinds of games in the preferred embodiments and many kinds of games can be conceived.

As described hereinabove, since according to the present invention the game can be played in such a way that the players arbitrarily record their own messages, play back the several kinds of voices which have been recorded in accordance with the predetermined procedures, and compete with each other to make scores, the vocal game apparatus can be devised such that even a skilled player does not easily tire of playing.

What is claimed is:

1. A vocal game apparatus comprising:

a plurality of input switches operated by one or a plurality of players;

recording means for recording for each input switch a corresponding voiced message;

memory means for storing the voiced messages;

reproducing means for reproducing the stored voiced messages in response to a reproduce command signal;

a plurality of indication means, installed so that each of said indication means corresponds to one of said input switches, for providing an indication and for prompting the players to input the voiced messages in accordance with prespecified game instructions;

control means for receiving input signals from said input switches, for producing output signals to control operations of said recording means and said indication means, and for producing the reproduce command signal, all according to the prespecified game instructions which utilize the recorded messages.

2. A vocal game apparatus according to claim 1, wherein each of said plurality of input switches is a different color.

3. A vocal game apparatus according to claim 1, further comprising:

a disk-shaped casing containing said recording means, reproducing means, and control means; and four cylindrical convex portions spaced 90° apart and projected radially from said disk-shaped casing, each of said cylindrical convex portions containing one of said plurality of input switches, said input switches being disposed within an opening on the upper surface of said convex portions, and projecting above each opening.

4. A vocal game apparatus according to claim 3, wherein each of said input switches is mounted in the respective opening of said convex portion enabled to make a pivotal movement in the up and down direction, said input switches being kept in a noncontact up position by elastic forces, downward pressure on said input switches producing an input; the upper portion of each input switch being constructed of a colored transparent material, the material being a different color for each said input switch.

5. A vocal game apparatus according to claim 3, wherein said disk-shaped casing further comprises:

an on/off switch situated on the upper surface of said casing for turning the apparatus on and off;

a recording microphone situated on the upper surface of said casing for receiving the messages to be recorded;

a speaker housed within said casing having an output surface on the upper surface of said casing for reproducing the messages; and a reset switch situated on the upper surface of said casing for restarting a game cycle.

6. A vocal game apparatus according to claim 1, wherein said recording means and said reproducing means are combined in a recording and reproducing large scale integration chip.

7. A method for playing games with a vocal game apparatus comprising the steps of:

recording sounds made by players;

selecting one of a plurality of prespecified games to be played;

reproducing the recorded sounds made by the players and lighting lights of the vocal game apparatus according to a set of game instructions for the selected game;

hitting input switches in response to the sounds and lights to score points;

recording the score of each player; and displaying the score of each player upon completion of the selected game.

8. A method for using a vocal game apparatus according to claim 7, wherein the game chosen in the selecting step is a match game, said selecting step further comprising registering players playing the match game; and said hitting step further comprising requiring an input from the player in response to a match of an input switch and the reproduced sound.

9. A method for using a vocal game apparatus according to claim 7, wherein the game chosen in said selecting step is a memory game, said reproducing step further comprises outputting a sequence of the lights and recorded sounds and said hitting step further comprises hitting the input switches in the identical order as output during the sequence; the length of the sequence starting at three and increasing by one following the hitting of the input switches in the identical order of the sequence.

* * * * *